US010745777B2

(12) United States Patent
Mahoney et al.

(10) Patent No.: US 10,745,777 B2
(45) Date of Patent: Aug. 18, 2020

(54) OXYGEN INJECTION IN FLUID BED ORE CONCENTRATE ROASTING

(71) Applicants: William J Mahoney, East Aurora, NY (US); Ahmed F Abdelwahab, Clarence Center, NY (US); Jeffrey C Mocsari, Hamilton, NY (US); Wim Coessens, Zarlardinge (BE); Dany BourdeaudHuy, Zottegem (BE); Ozhan Turgut, South Windsor, CT (US)

(72) Inventors: William J Mahoney, East Aurora, NY (US); Ahmed F Abdelwahab, Clarence Center, NY (US); Jeffrey C Mocsari, Hamilton, NY (US); Wim Coessens, Zarlardinge (BE); Dany BourdeaudHuy, Zottegem (BE); Ozhan Turgut, South Windsor, CT (US)

(73) Assignee: PRAXAIR TECHNOLOGY, INC, Danbury, CT (US)

( * ) Notice: Subject to any disclaimer, the term of this patent is extended or adjusted under 35 U.S.C. 154(b) by 0 days.

(21) Appl. No.: 16/139,949

(22) Filed: Sep. 24, 2018

(65) Prior Publication Data

US 2019/0112687 A1 Apr. 18, 2019

Related U.S. Application Data

(60) Provisional application No. 62/571,838, filed on Oct. 13, 2017.

(51) Int. Cl.

| | |
|---|---|
| ***C22B 1/06*** | (2006.01) |
| ***C22B 1/10*** | (2006.01) |
| ***C22B 5/14*** | (2006.01) |
| ***C22B 13/00*** | (2006.01) |
| ***C22B 15/00*** | (2006.01) |
| ***C22B 19/34*** | (2006.01) |
| ***C22B 23/00*** | (2006.01) |

(52) U.S. Cl.

CPC ..... *C22B 1/06* (2013.01); *C22B 1/10* (2013.01); *C22B 5/14* (2013.01); *C22B 13/00* (2013.01); *C22B 15/0017* (2013.01); *C22B 19/34* (2013.01); *C22B 23/005* (2013.01)

(58) Field of Classification Search

None

See application file for complete search history.

(56) References Cited

U.S. PATENT DOCUMENTS

| | | | |
|---|---|---|---|
| 2,825,628 | A | 3/1958 | Johannsen et al. |
| 5,123,956 | A | 6/1992 | Fernandez et al. |
| 7,044,996 | B2 | 5/2006 | Taskinen et al. |

FOREIGN PATENT DOCUMENTS

| | | | |
|---|---|---|---|
| SU | 620095 | A1 * | 9/1979 |
| SU | 620095 | A1 | 9/1979 |
| SU | 1659501 | A1 | 6/1991 |

* cited by examiner

*Primary Examiner* — Melissa S Swain
(74) *Attorney, Agent, or Firm* — Donald T. Black

(57) ABSTRACT

Oxygen is injected into the windbox of a fluidized bed ore roaster to form a fluidizing and oxidizing gas stream of elevated oxygen content which is fed into only the feed zone into which the ore to be fluidized is fed.

4 Claims, 2 Drawing Sheets

OXYGEN INJECTION IN FLUID BED ORE CONCENTRATE ROASTING

RELATED APPLICATIONS

This application claims the benefit of U.S. Provisional Application Ser. No. 62/571,838, filed on Oct. 13, 2017, which is incorporated herein by reference.

FIELD OF THE INVENTION

The present invention relates to roasting of metallic sulfidic material, such as metal ores, in fluidized beds.

BACKGROUND OF THE INVENTION

In general, processes for fluidized bed roasting of sulfide materials are technically and commercially known. The raw materials (ore concentrates) are fed into a roaster where they are fluidized, in a fluidized bed which is maintained by passing air upwards through a grate or distributor plate which incorporates numerous air nozzles that pass through the grate or plate. The fluidizing gas, typically air, contains oxygen which reacts with the sulfidic material to convert sulfides to oxides. The depth of the fluidized bed is controlled by withdrawing roasted concentrate either as bed overflow or underflow. The gas, after passing through the bed and fluidizing the bed, may contain finer particles that are entrained in the gas flow and are subsequently separated from the gas by known techniques such as filters or electrostatic precipitators. The gas from the bed contains sulfur dioxide, so the gas is typically sent to a sulfuric acid plant. The roasted product is generally referred to as calcine. The oxidation of sulfidic compounds in the material is autothermal and excess heat is available from the oxidation reaction. Examples of sulfidic minerals processed in fluidized bed roasters include materials that contain sulfides of zinc, copper, lead, iron, nickel and molybdenum.

It can be desirable to provide that the amount of oxygen that is available for interaction with the sulfidic material is different at different locations on the grate or distributor plate, for instance to be able to handle different characteristics of the bed material nearer to, and farther from, the zone into which the sulfidic material is fed.

Previous techniques for varying the amount of oxygen that is passed into the bed of sulfidic material have generally varied the number of passages, and/or varied the size of the passages, through the grate or distributor plate, through which the oxygen-containing gas is fed into the bed from the space below the bed. Thus, where it is desired to provide a higher oxygen content in one region of the bed, one would provide more passages and/or would provide larger passages, relative to the number of passages and/or the size of the passages that feed oxygen-containing fluidizing gas to other regions of the bed.

This technique is described in U.S. Pat. No. 7,044,996, which teaches that an oxygen deficit in the vicinity of the area (the feed grate) where bed material is fed into the roaster can be remedied by increasing the number of gas nozzles in the vicinity of the feed grate, and by using bigger gas nozzles in the vicinity of the feed grate, relative to the number of gas nozzles and the size of gas nozzles that are used to feed gas at the rest of the grate. This patent refers to these as techniques to increase the "oxygen content" of the gas that is fed at the feed grate, but it is clear that this patent means by "oxygen content" the total overall amount of oxygen that is fed to one region or another on the grate. U.S. Pat. No. 7,044,996 does not at all recognize the innovation which the present inventors have discovered that relates to increasing the actual oxygen concentration of the fluidizing gas which passes through a selected limited number of the passages through the grate, relative to the actual oxygen concentration of the fluidizing gas that passes through other passages into other regions of the bed. In particular, in comparing the present invention to the disclosure of U.S. Pat. No. 7,044,996, it can be seen that U.S. Pat. No. 7,044,996 does not contain any disclosure of providing such varied oxygen concentrations passing through various openings in the grate, nor any disclosure of how one might accomplish providing such varied oxygen concentrations. Instead, U.S. Pat. No. 7,044,996 teaches only the use of only a single gaseous oxygen-containing fluidizing gas passing through every one of the passages in the grate.

BRIEF SUMMARY OF THE INVENTION

The present invention achieves the numerous advantages that are described herein, in a method of roasting metal-sulfidic material that comprises (A) feeding solid particulate metal-sulfidic material into a roaster having a distribution plate that supports solid particulate material fed into the roaster, wherein the material is fed into a feed zone above the distribution plate that comprises less than the entirety of the upper surface of the distribution plate, wherein the roaster includes space below the distribution plate, and wherein passages are present through the distribution plate which have inlets that are open to the space and have outlets in the upper surface of the distribution plate that are in the feed zone, and wherein passages are present through the distribution plate which have inlets that are open to the space and have outlets in the upper surface of the distribution plate that are not in the feed zone;

(B) feeding oxygen-containing gas into space that is under the distribution plate;

(C) injecting oxygen-bearing enrichment gas whose oxygen concentration is higher than the oxygen concentration of the oxygen-containing gas into a region of said space that is under said feed zone and mixing said oxygen-bearing enrichment gas with oxygen-containing gas in said region to form oxygen-enriched oxidant gas in said region; and (D) feeding said oxygen-enriched oxidant gas from said space through passages in said distribution plate under and into the metal-sulfidic material in the feed zone while feeding said oxygen-containing gas from said space through passages in said distribution plate that are not under the feed zone.

Another aspect of the present invention is a method of modifying the operation of a fluidized bed roaster, in which operation solid particulate metal-sulfidic material is fed into a roaster having a distribution plate that supports solid particulate material fed into the roaster, wherein the material is fed into a feed zone above the distribution plate that comprises less than the entirety of the upper surface of the distribution plate, wherein the roaster includes space below the distribution plate, and wherein passages are present through the distribution plate which have inlets that are open to the space and have outlets in the upper surface of the distribution plate that are in the feed zone, and wherein passages are present through the distribution plate which have inlets that are open to the space and have outlets in the upper surface of the distribution plate that are not in the feed zone, and oxygen-containing gas is fed into space that is under the distribution plate, the method comprising (A) injecting oxygen-bearing enrichment gas whose oxygen concentration is higher than the oxygen concentration of the oxygen-containing gas into a region of said space that is under said feed zone and mixing said oxygen-bearing enrichment gas with oxygen-containing gas in said region to form oxygen-enriched oxidant gas in said region; and (B) feeding said oxygen-enriched oxidant gas from said space through passages in said distribution plate under and into the metal-sulfidic material in the feed zone while feeding said oxygen-containing gas from said space through passages in said distribution plate that are not under the feed zone.

DETAILED DESCRIPTION OF THE INVENTION

The present invention is useful in the processing of metal-sulfidic material, by which is meant solid particulate material that contains one or more sulfides of one or more metals. Preferred examples are ores and mixed ores of metals. Metals typically present in materials that can be processed using this invention include zinc, copper, lead, iron, nickel and molybdenum. For example, when zinc is present, the primary overall reaction upon roasting with oxygen present is $$ZnS+1.5\ O2 \rightarrow ZnO+SO2$$

Figure 1:
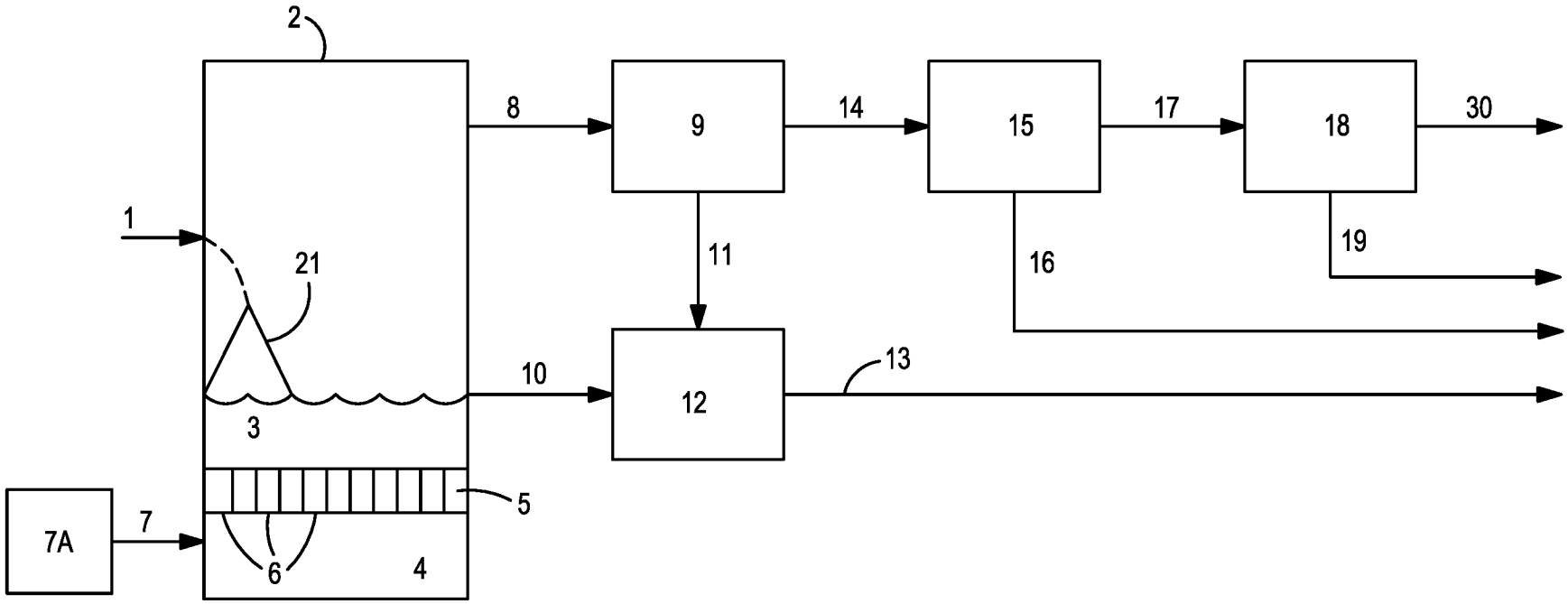
FIG. 1 is a flowsheet of a process for roasting sulfidic ore.

A typical processing train in which the present invention can be utilized is shown in FIG. 1. The metal-sulfidic material is fed through feed port 1 into roaster 2 where it accumulates as bed 3 supported by distribution plate 5. Roasters with which the present invention can be practiced can have one feed port, as shown, or can have more than one feed port (each of which would be as shown in the Figures). Windbox 4 is below distribution plate 5. Preferably, windbox 4 constitutes a single undivided unitary space under distribution plate 5, that is, there should not be any partitions or barriers that divide windbox 4 into more than one space. In this preferred arrangement, gas anywhere in the windbox 4 space is not prevented from being accessible to the passages described herein through the distributor plate.

Many dozens or even hundreds (the number depending on the size of the distribution plate) of passages 6 extend through distribution plate 5 to permit fluidizing gas to flow from windbox 4 into roaster 2, and into bed 3 when bed 3 is present. A distributor plate can typically contain on the order of 100 nozzles per square meter of distributor plate surface. Oxygen-containing gas 7 is fed into windbox 4 under the force of blower 7A, and flows into, through, and out of the passages 6 into bed 3, with sufficient momentum that the gas passes into and fluidizes the material of bed 3, where the oxygen in the gas reacts with the material in the bed. The oxygen-containing gas 7 is typically air, and can be oxygen-enriched air or other gaseous stream that contains oxygen.

The oxygen concentration of the oxygen-containing gas 7 should be in the range of 20.9 vol. % to 40 vol. % and preferably in the range of 20.9 vol. % to 28 vol. %.

In operation, the oxygen in the oxygen-containing gas 7 reacts with the sulfidic material to convert metal sulfides to metal oxides and mixtures of metal oxides, with the sulfur of the sulfidic material converted to form sulfur dioxide and usually other sulfur oxides, sulfites and/or sulfates which may be gaseous as well as particulate solids. The temperature at which these reactions occurs in the fluidized bed 3 are typically in the range of 900 to 970 degrees C. Care should be taken to control the flow of fluidizing and oxidizing gas so that the temperature in the bed 3 does not become so high that the bed material softens or melts.

Stream 10 of solid oxidized, oxidic metal material is passed out of roaster 2 to unit 12 where it can be collected and preferably is cooled. Stream 8 of gas produced by the roasting is passed out of roaster 2 to unit 9 where stream 8 can be cooled. Cooling often is accomplished by indirect heat transfer with water to produce steam. Any solids that are separated from stream 8 in unit 9 can be passed as stream 11 to join stream 10, for instance in unit 12.

Oxidic solids are passed from unit 12 as stream 13 to be conveyed for use or for further processing, typically to recover the metal values therein. The cooled gas that is formed in unit 9 passes from unit 9 as stream 14 to gas-solid separation unit 15, such as a cyclone, where particulate solids that had been entrained in the gas stream are removed, and can then be passed as stream 16 which can be passed along for further processing. The gas stream that is produced in unit 15 is passed as stream 17 to another gas-solid separation unit such as an electrostatic precipitator 18, for removal of additional entrained solids 19, thereby forming cleaned stream 30 which can be conveyed for further processing. Typical further processing of stream 30 involves feeding stream 30 to a plant that converts the sulfur oxides in stream 30 to sulfuric acid.

Figure 2:
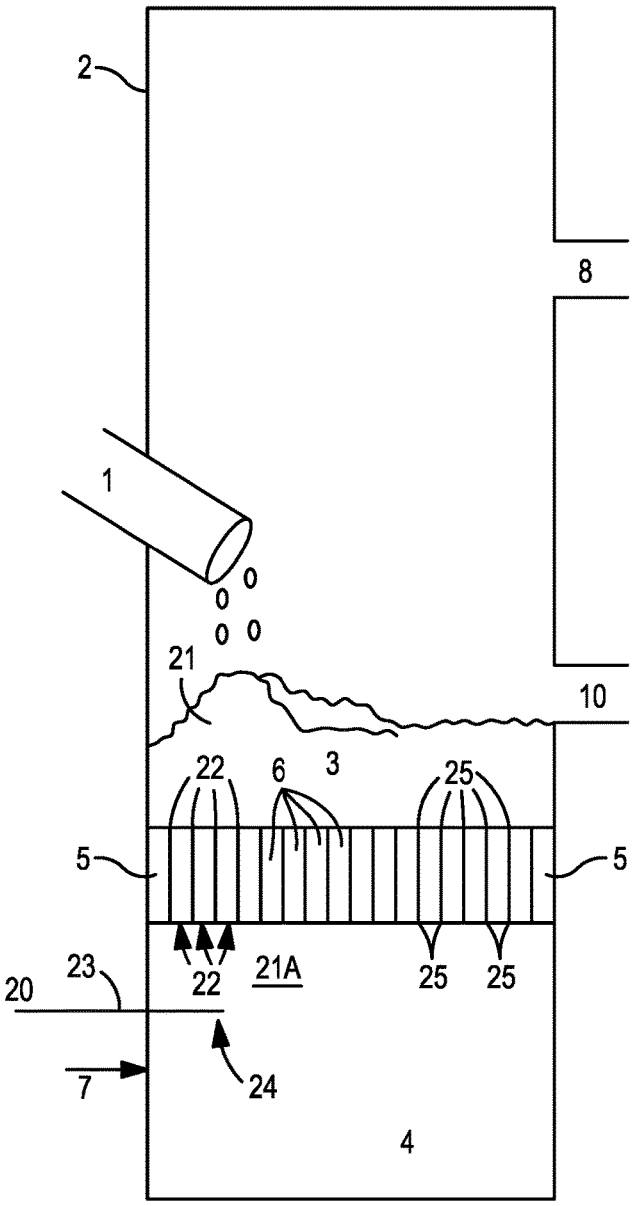
FIG. 2 is a side cross-sectional view of a roaster with which the present invention can be practiced.

FIG. 2 shows in cross-section a typical roaster with which the present invention can be practiced. Roaster 2 includes feed port 1 through which the metal-sulfidic material is fed into roaster 2 where it accumulates as bed 3 on distribution plate 5. Oxygen-containing gas 7 is fed into windbox 4 and then passes upward through the passages 6 in distribution plate 5 into bed 3. Gaseous stream 8 formed by the roasting exits roaster 2. Roasted solid product 10 is passed out of roaster 2 periodically or continuously.

Figure 3:
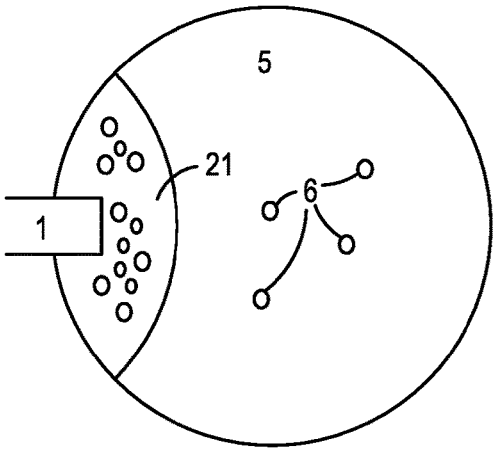
FIG. 3 is a top cross-sectional view of the roaster of FIG. 2.

The solid metal-sulfidic material 1 that is fed into roaster 2 falls from the downstream end of feed port 1 and comes to rest within feed zone 21, which is defined as the area on the top surface of bed 3 on which material that is fed through feed port 1 lands (when bed 3 is already present in roaster 2). The feed zone can also be defined as the section of the bed that is deficient in oxygen relative to the overall oxygen content in the bed. Just as there can be more than one feed port, as mentioned above, there can be more than one feed zone, typically with one distinct feed zone for each feed port. Feed zone 21 is also seen from above in FIG. 3, where feed zone 21 is under the outlet of feed port 1. Passages 6 are shown, though not all of the passages are shown which would be present in a roaster used in actual practice.

In the practice of the present invention, stream 20 of oxygen-bearing enrichment gas is provided into windbox 4 through a sidewall of windbox 4. In newly constructed roasters and roasters that have already been constructed, the stream 20 can be provided by drilling a hole (or holes) through a side of the existing windbox 4 and installing a lance 23 partway through the hole so that the outlet 24 of the lance 23 is under the feed zone 21, and feeding oxygen-bearing enrichment gas through the lance into the region 21A under feed zone 21. The oxygen concentration of the oxygen-bearing enrichment gas 20 should be in the range of 25 vol. % to 100 vol. % and preferably in the range of 50 vol. % to at least 95 vol. %, more preferably at least 99 vol. % to 100 vol. %. Using industrially pure oxygen (such as at least 99 vol. % oxygen) minimizes the size of the lances and simplifies the flow control equipment in that no blending of oxygen and air is needed. In addition, the oxygen concentration of stream 20 should be greater than the oxygen concentration of the oxygen-containing gas 7.

Stream 20 is fed into windbox 4 at a location that is vertically below the feed zone 21. Stream 20 mixes with oxygen-containing gas in windbox 4 in the region 21A that is under feed zone 21 to form oxygen-enriched oxidant gas that has an oxygen concentration which is higher than the oxygen concentration of the oxygen-containing gas. The oxygen concentration of the oxygen-enriched oxidant gas 22, which is not necessarily uniform throughout the region 21A under feed zone 21, should be in the range of 23 vol. % to 95 vol. % and preferably in the range of 25 vol. % to 75 vol. %.

The oxygen-enriched oxidant gas (represented as 22) is passed through the passages 6 which are under the feed zone 21, and thus passes into the portion of bed 3 that contains metal-sulfidic material that has been freshly fed onto bed 3 through feed port 1. The oxygen-containing gas (represented as 25) that has not been mixed with oxygen-bearing enrichment gas passes through openings 6 that are not under feed zone 21. Thus, the oxygen concentration of the fluidizing gas that engages material in bed 3 that is in the feed zone 21 is higher than the oxygen concentration of the fluidizing gas that engages material in bed 3 that is not in feed zone 21. This result can be achieved even if the sizes (cross-sectional areas) of the passages 6 under feed zone 21 and not under feed zone 21 are the same, and even if the number of passages per unit area of distribution plate that are present under feed zone 21 is the same as the number of passages per unit area of distribution plate that are present not under feed zone 21. The fluidizing nozzles are usually converging nozzles with round cross sections, but other configurations are also effective.

To form the desired oxygen-enriched oxidant gas in windbox 4 under feed zone 21, stream 20 should be fed at a feed rate relative to the feed rate of oxygen-containing gas 7 so that the mixing of streams 20 and 7 forms a stream 22 having the desired enriched concentration of oxygen. It is possible that the fluidizing gas that engages material in bed 3 that is not in feed zone 21 may have an oxygen concentration that is higher, such as up to 5 vol. % higher, than the oxygen content of the oxygen-containing gas that is fed into the windbox 4.

The implementation of this invention preferably utilizes oxygen lances 23 installed in the sidewall of the windbox 4. The lances 23 are designed to emit streams of oxygen-enrichment gas which target the oxygen-containing gas in the area of windbox 4 under the passages that feed oxygen-enriched oxidant directly into the feed zone 21. The streams emerge from an outlet 24 at the end of each lance 23. Each outlet can be a single opening or multiple openings.

In a preferred procedure to design the equipment and conditions that achieve these objectives, it is very useful to gain an understanding of the background flow-field of the air (or oxygen enriched air) in the windbox 4. The windbox 4 flow field will be unique to each roaster and depends on the flow parameters and geometry of the windbox. The background flow is further influenced by the presence of structural supports such as I-beams and probe positions. A preferred approach to perform this task is to simulate the air flow in the windbox 4 using computational fluid dynamics (CFD).

The output from the CFD study then provides the background velocity field into which the jets of oxygen-bearing enrichment gas must penetrate so as to interact and mix with the oxygen-containing gas in the windbox 4 to produce oxygen-enriched oxidant gas which is what is intended to enter the passages that will feed this gas into the bed 3 in the feed zone 21.

Given knowledge of the background windbox velocity field (from CFD), windbox geometry and location of the feed zone(s), this design procedure can proceed from a first estimation towards the number of injectors, positions, oxygen flow rate, nozzle design and lance insertion position followed by additional calculations that are iteratively performed on the streams injected into the windbox to optimize the conditions based on the observed flows into the bed 3 in the feed zone 21. After a satisfactory result is achieved, the design information can be used for commercial fabrication of lances.

Mixing of streams 7 and 20 to form the desired mixed stream 22 can be promoted by using simple pipes or converging nozzles with subsonic velocity, or by using injectors with a pair of converging nozzles installed at the tip to angle the jets to enhance coverage of the feed zone target. Supersonic jets might be used instead, with converging-diverging nozzles to increase penetration of the oxygen feed stream through the windbox atmosphere.

In addition, streams 7 and 20 should be fed at rates such that, taking into account the respective oxygen concentration in each of these streams, and taking into account the rate at which sulfidic material is fed into the roaster and the oxidizable content of that material, the streams 7 and 20 together provide enough oxygen to completely oxidize the sulfidic content of the material that is fed into the roaster. Preferably, the amount of oxygen that is provided by streams 7 and 20 should be at least 100%, and preferably at least 105%, of the total stoichiometric requirement of the metal-sulfidic material. These amounts and rates can be readily determined from knowledge of the chemical formulas and content of the sulfidic material, combined with the oxygen concentrations of the streams 7 and 20 to be used.

The present invention is especially advantageous in that it enables the operator to overcome oxygen deficiency in the region of bed 3 that is at the feed side of the furnace. The "oxygen coefficient" of a roaster determines the availability of oxygen for the complete roasting of the concentrate, i.e., the ratio of total oxygen in the process gas to the oxygen requirement of the feed mixture for the formation of stable oxides and sulfates in the roaster off-gas. In general, the oxygen coefficient in the feed zone is lower, due to the high local concentration of sulfidic "fuel" (from the feed) and this invention is an efficient method to address this imbalance.

Also importantly, the invention can be used to enhance the ability to roast lower quality raw materials, i.e., concentrate blends with finer particle size distribution and greater impurity concentration, especially lead and copper. Copper is a critical component in roasting and behaves differently than lead. The greater the copper impurity, the higher the oxygen coefficient must be to avoid sintering in the bed (due to lower temperature melting phase), which enables fluidization problems. With high copper, the oxygen coefficient must be kept high to counter the lower bed temperature operation required to reduce agglomeration phenomena.

What is claimed is:

1. A method of roasting metal-sulfidic material, comprising (A) feeding solid particulate metal-sulfidic material into a roaster having a distribution plate that supports solid particulate material fed into the roaster, wherein the material is fed into a feed zone above the distribution plate that comprises less than the entirety of the upper surface of the distribution plate, wherein the roaster includes space below the distribution plate, and wherein passages are present through the distribution plate which have inlets that are open to the space and have outlets in the upper surface of the distribution plate that are in the feed zone, and wherein passages are present through the distribution plate which have inlets that are open to the space and have outlets in the upper surface of the distribution plate that are not in the feed zone;

(B) feeding oxygen-containing gas into space that is under the distribution plate;

(C) injecting oxygen enrichment gas whose oxygen concentration is higher than the oxygen concentration of the oxygen-containing gas into a region of said space that is under said feed zone and mixing said enrichment gas with oxygen-containing gas in said region to form oxygen-enriched oxidant gas in said region; and (D) feeding said oxygen-enriched oxidant gas from said space through passages in said distribution plate under and into the metal-sulfidic material in the feed zone while feeding said oxygen-containing gas from said space through passages in said distribution plate that are not under the feed zone.

2. A method according to claim 1 wherein the space under the distribution plate is free of barriers that prevent oxygen-containing gas that is fed into said space from being accessible to the inlets of all of said passages through the distribution plate.

3. A method of modifying the operation of a fluidized bed roaster, in which operation solid particulate metal-sulfidic material is fed into a roaster having a distribution plate that supports solid particulate material fed into the roaster, wherein the material is fed into a feed zone above the distribution plate that comprises less than the entirety of the upper surface of the distribution plate, wherein the roaster includes space below the distribution plate, and wherein passages are present through the distribution plate which have inlets that are open to the space and have outlets in the upper surface of the distribution plate that are in the feed zone, and wherein passages are present through the distribution plate which have inlets that are open to the space and have outlets in the upper surface of the distribution plate that are not in the feed zone, and oxygen-containing gas is fed into space that is under the distribution plate, the method comprising (A) injecting oxygen enrichment gas whose oxygen concentration is higher than the oxygen concentration of the oxygen-containing gas into a region of said space that is under said feed zone and mixing said enrichment gas with oxygen-containing gas in said region to form oxygen-enriched oxidant gas in said region; and (B) feeding said oxygen-enriched oxidant gas from said space through passages in said distribution plate under and into the metal-sulfidic material in the feed zone while feeding said oxygen-containing gas from said space through passages in said distribution plate that are not under the feed zone.

4. A method according to claim 3 wherein the space under the distribution plate is free of barriers that prevent oxygen-containing gas that is fed into said space from being accessible to the inlets of all of said passages through the distribution plate.

* * * * *